US008398450B2

(12) United States Patent
Grichting

(10) Patent No.: US 8,398,450 B2
(45) Date of Patent: Mar. 19, 2013

(54) CONNECTION MEANS FOR CONSTRUCTION ELEMENTS, AND ASSOCIATED SET OF BUILDING BLOCKS

(75) Inventor: Wilfried Grichting, Leukerbad (CH)

(73) Assignee: Techno Bloxx AG (CH)

( * ) Notice: Subject to any disclaimer, the term of this patent is extended or adjusted under 35 U.S.C. 154(b) by 182 days.

(21) Appl. No.: 12/162,680

(22) PCT Filed: Jan. 18, 2007

(86) PCT No.: PCT/CH2007/000021
§ 371 (c)(1),
(2), (4) Date: Jul. 30, 2008

(87) PCT Pub. No.: WO2007/087734
PCT Pub. Date: Aug. 9, 2007

(65) Prior Publication Data

US 2009/0017715 A1 Jan. 15, 2009

(30) Foreign Application Priority Data

Jan. 31, 2006 (EP) ..... 06405046

(51) Int. Cl.
*A63H 33/04* (2006.01)
*A63H 33/08* (2006.01)

(52) U.S. Cl. ..... 446/85; 446/124; 446/127

(58) Field of Classification Search ..... 446/85, 446/107, 108, 120–127
See application file for complete search history.

(56) References Cited

U.S. PATENT DOCUMENTS 1,446,868 A * 2/1923 Baker ..... 446/126
4,160,337 A * 7/1979 Fischer ..... 446/127
5,487,691 A * 1/1996 Chiu ..... 446/126
5,645,463 A * 7/1997 Olsen ..... 446/104
5,788,555 A * 8/1998 Glynn ..... 446/124
5,957,744 A * 9/1999 Mott et al. ..... 446/127

(Continued)

FOREIGN PATENT DOCUMENTS

CH 428 529 1/1967
DE 197 15 710 11/1997

(Continued)

OTHER PUBLICATIONS

Notification of Transmittal of Translation of the International Preliminary Report on Patentability and the English Translation of the International Preliminary Report on Patentability (Chapter II) tor International Application No. PCT/CH2007/000021, International Filing Date of Jan. 18, 2007 (6 pages total).

(Continued)

*Primary Examiner* — Gene Kim
*Assistant Examiner* — Alyssa Hylinski
(74) *Attorney, Agent, or Firm* — Ostrolenk Faber LLP

(57) ABSTRACT

A connecting means for construction elements, e.g. (toy) building blocks, comprises a strip-shaped member having a thickened portion and a component of a detachable connecting mechanism. The strip-shaped member is insertable into a groove in the side faces of the construction elements. To that component of the detachable connection, e.g. to a nut, further construction elements can be attached in a simple but stable manner. The detachable mechanism is preferably the one that is provided in the construction element for connections without using the connecting means. The connecting means thus allows an extension of the assembly possibilities in a stable manner in other directions than those provided by the construction elements themselves.

14 Claims, 2 Drawing Sheets

U.S. PATENT DOCUMENTS

| | | | | |
|---|---|---|---|---|
| 6,050,044 | A * | 4/2000 | McIntosh | 52/591.1 |
| 2003/0203702 | A1 * | 10/2003 | Germerodt et al. | 446/85 |

FOREIGN PATENT DOCUMENTS

| | | | |
|---|---|---|---|
| DE | 202 06 532 | | 8/2002 |
| EP | 1464369 | A1 * | 10/2004 |
| FR | 2 563 746 | | 11/1985 |
| GB | 1094418 | | 12/1967 |
| WO | WO 2004/087277 | | 10/2004 |

OTHER PUBLICATIONS

International Search Report mailed Apr. 5, 2007 in corresponding PCT International Application No. PCT/CH2007/000021.

* cited by examiner

CONNECTION MEANS FOR CONSTRUCTION ELEMENTS, AND ASSOCIATED SET OF BUILDING BLOCKS

CROSS-REFERENCE TO RELATED APPLICATIONS

The present application is a 35 U.S.C. §§371 national phase conversion of PCT/CH2007/000021, filed Jan. 18, 2007, which claims priority of European Patent Application No. 06405046.1, filed Jan. 31, 2006, the disclosure of which has been incorporated herein by reference. The PCT International Application was published in the German language.

BACKGROUND OF THE INVENTION

1. Field of the Invention

The present invention relates to a connecting means for construction elements. The invention further relates to a building block set having a connecting means of this kind.

2. Description to the Related Art

Known in the art are building block systems, e.g. toy building block systems for children, that are interconnectable by plugging them together or by simple screw connections. A system of this kind is described in WO-A-2004/87277 to the applicant of the present invention. In order to be attractive to play and controllable, it is desirable to provide only a relatively small number of different elements and, particularly for smaller children, to make the building blocks relatively large.

Like other building block systems, the present one also comprises a connecting mechanism where elements that are shaped essentially complementarily to each other are pushed into one another in the building direction. In contrast to other systems where a clamping effect and thus a frictional connection is involved, the present elements slide in each other lightly. A stabilization and fastening can be obtained by a screw connection through the elements of the mechanism.

Problematic, however, are constructions that are not only built in one direction, e.g. upwards, but are to be continued in a second direction, e.g. laterally, or where the building direction is even reversed. An example thereof could be a laterally projecting arm as for a crane to which a downwardly hanging object is attached. Systems that are based on a clamping effect typically allow only a reversal at the most, but wear and thus a reduced clamping effect soon lead to stability problems. If the cohesion is due to the clamping effect alone, the stability is already limited by principle.

Another possibility consists in including particular connecting elements for transversal or reversible connections in the building block system. However, this increases the number of building block types, and the building block system becomes intransparent and thus uninteresting for the user.

SUMMARY OF THE INVENTION

It is therefore an object of the present invention to provide an arrangement that allows building blocks provided with a connecting mechanism in at least one main direction to be used for building in a second direction in which the building blocks have no elements of the connecting mechanism.

A connecting means that embodies such an arrangement is described below. The following claims indicate preferred embodiments and building block systems having such a connecting means.

Accordingly, the invention consists in providing a connecting means that allows a combination of a push-in connection and of a second, detachable connecting mechanism. Such a connecting mechanism is already provided e.g. in the building block system to the applicant of the present invention mentioned in the introduction in the form of a screw connection. However, in this toy building block system of the prior art, this screw connection, the prototype of an actuatable connecting mechanism, is only designed as a connection in a first direction, e.g. the upward direction. Push-in connections are only provided for decorative insertion panels, for which purpose the toy building blocks have slots or grooves in their side walls. According to the invention, the slots in the side walls are modified so as to have an enlargement, preferably at the bottom. The connecting means of the invention has a corresponding strip-shaped portion that is also provided with corresponding thickened portions, preferably at its front end or its front edge, respectively. It is thus insertable into a modified groove in the longitudinal direction but cannot be pulled out transversally. On the other hand, the connecting means comprises a part of the connecting mechanism of the toy building block system, e.g. the nut of a screw connection. It is thus possible in a simple manner to provide a side wall of a building block with a component of a connecting mechanism (nut of a screw connection), thereby allowing to continue building transversally to the original main building direction. This connecting mechanism is the one that interconnects the building blocks in the main building direction (or alternatively in the building directions). More particularly, it is a push-in connection that may additionally be combined with another positive attachment mode such as a screw, snap-in, bayonet or twist connection in order to ensure a firm cohesion.

Consequently, the building block system is essentially only complemented by this additional part, i.e. the connecting means, thereby keeping the complexity of the overall system low and maintaining its attractiveness, particularly for smaller children, or even increasing it due to the extended constructive possibilities. Another advantage is that by the simple addition of the connecting means, these additional constructive possibilities are obtained with already existing building blocks, thereby keeping the acquisition costs low.

BRIEF DESCRIPTION OF THE DRAWINGS

The invention will be further explained by means of a preferred exemplary embodiment and with reference to the figures.

DESCRIPTION OF A PREFERRED EMBODIMENT

Figure 1:
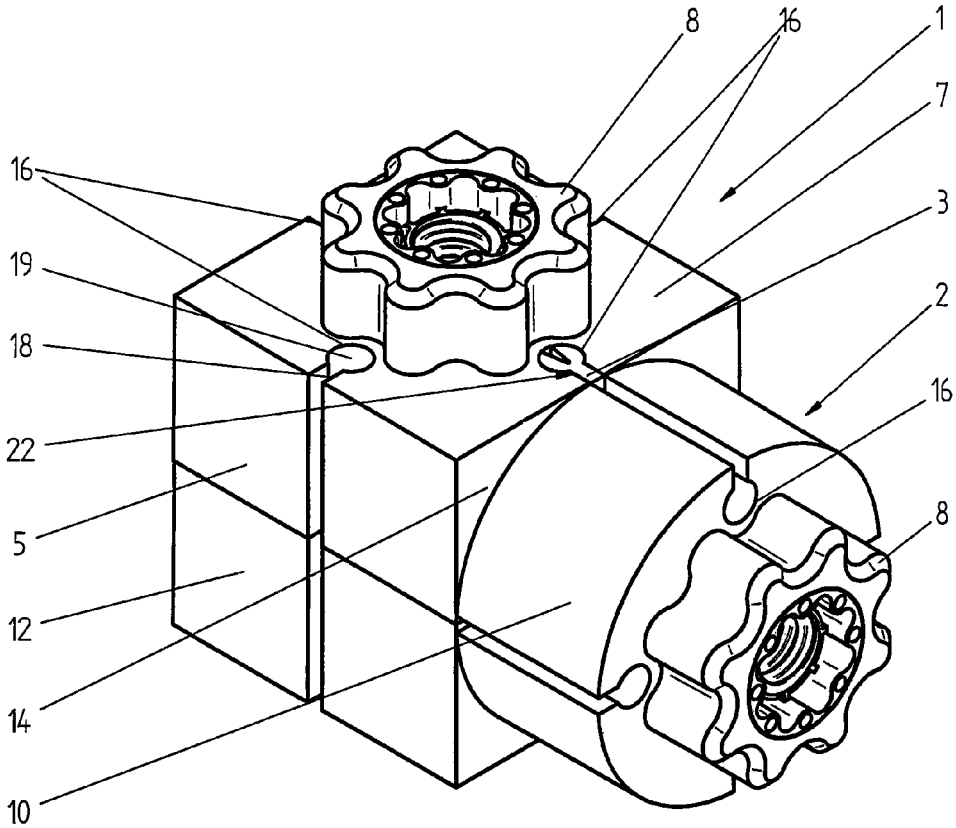
FIG. 1 view of a building block with a laterally adjoined second building block.

In FIG. 1, a first building block 1 is illustrated (more precisely: 2 building blocks that are stacked, see the separating line in the middle, to adapt its height to the diameter of the adjoined building block), to which a second building block 2 is fastened laterally by means of a connecting means 3 according to the invention. The building blocks are essentially realized here according to WO-A-2004/87277 to the applicant of the present invention. The first building block has a cuboidal body 5. In the main building direction, on a face 7, the characteristic stud 8 for the attachment of further building blocks is provided. This face 7 is referred to as the "top face". On the opposite bottom face (not shown) of building block body 5, a recess is provided whose shape is complementary to that of stud 8. As described in the cited WO publication, these building blocks may have different shapes and comprise a plurality of studs, recesses or only recesses, etc. One variant is seen in FIG. 1 already: building block 2 has an essentially cylindrical body 10.

The side faces of body 5, of which front face 12 and left-hand face 14 are visible, are provided with grooves 16. Starting from their opening, each groove 16 first comprises a passage 18 having a constant width that is followed toward the bottom of the groove by an essentially cylindrical enlargement 19 (see also FIG. 2).

Figure 3:
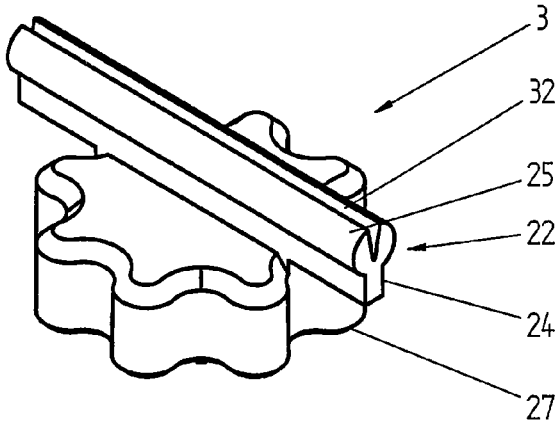
FIG. 3 view from above of a connecting means of the invention.
Figure 4:
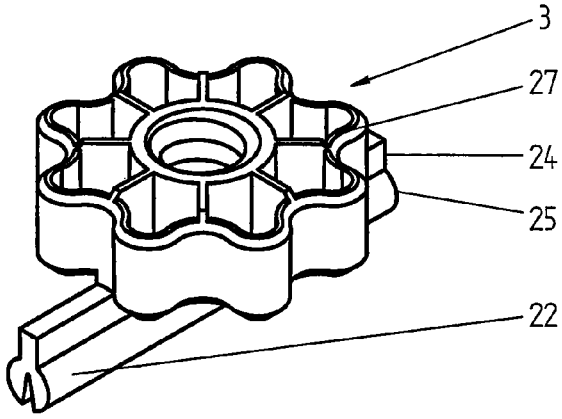
FIG. 4 view from below of the connecting means of FIG. 3.
Figure 5:
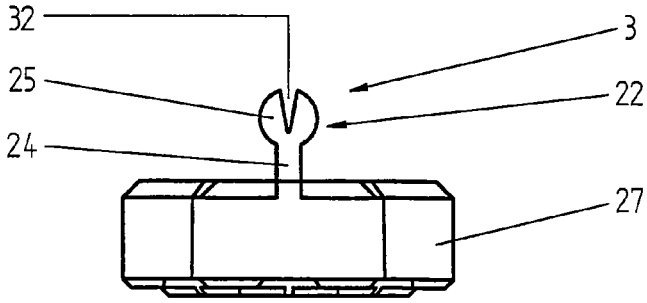
FIG. 5 lateral view of the connecting means of FIG. 3.

Connecting means 3 has a strip-shaped member 22 whose shape is essentially complementary to that of groove 16 and which is slidable into a groove 16 from the top or from the bottom. Correspondingly, strip-shaped member 22 includes a strip-shaped neck 24 at the front edge of which an essentially cylindrical thickened portion 25 is arranged (see FIGS. 3, 5). Centrally at the rear edge of web-shaped neck 24, a nut 27 of the building block system is arranged whose shape visibly corresponds to that of studs 8 whereas it is provided with an internal thread 28 (see FIG. 4).

Figure 2:
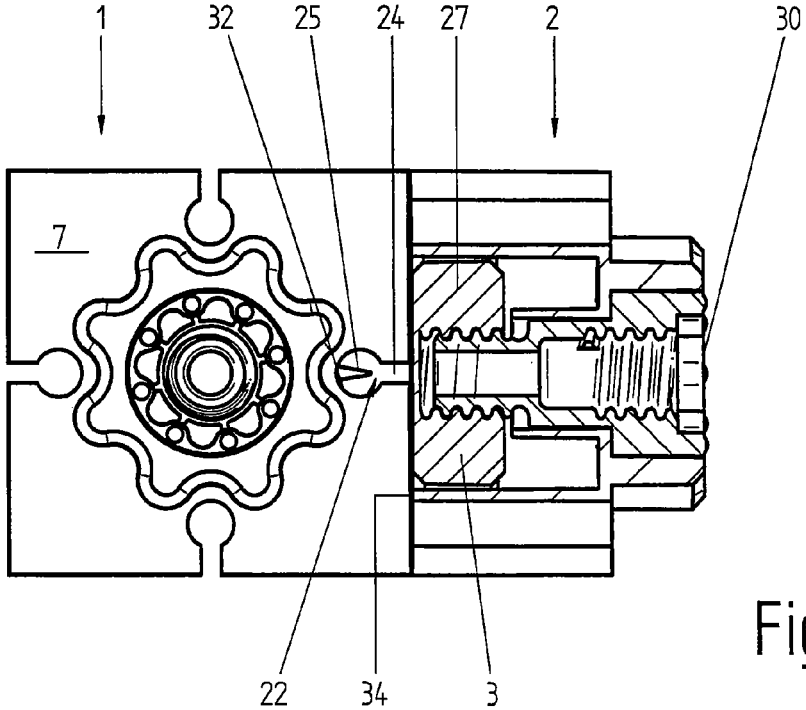
FIG. 2 top view of the arrangement of FIG. 1 with partial section of the laterally added building block according to I-I.

Thus, after the insertion of the coupling portion or connecting means 3 into a groove 16 of a building block, a nut 27 is provided on that face. As shown in FIG. 2, another building block 2 can be fitted onto this nut 27 and fastened by means of a screw 30.

Manifestly it is thus possible, merely by the introduction of coupling portion 3, to provide the standard building blocks with the possibility to continue building laterally in one or several directions simultaneously as required. The laterally adjoined building blocks 2 are secured by screws 30 that are also known in the art already, thereby yielding a highly stressable connection. By combining these lateral connections it is possible to further change the building direction, e.g. to reverse it or even to achieve annular constructions in the largest sense. In addition, at least in the building block system of the applicant, the blocks may be assembled in positions rotated by 45° angles, thereby resulting in further variants.

Furthermore, coupling portion 3 only requires the presence of the grooves. As seen in FIG. 1, building block 2 with cylindrical body 10 is also provided with grooves 16 on its circumference. Generally, but more particularly also on a cylindrical building block body, it is thus possible to provide the grooves in a different arrangement and number, e.g. at 45° intervals.

The front edge of thickened portion 25 has a wedge-shaped incision. The function of the latter is to provide thickened portion 25 with a small amount of flexibility in order to facilitate its insertion into a groove 16 in the case of a tight fit or to adjust the increase of the clamping effect between strip-shaped member 22 and groove 16 while tightening screw 30. Particularly in view of the requirements of smaller children, strip-shaped member 22 and groove 16 are designed so as to be easily insertable into one another. Surprisingly and advantageously it has been found that a clamping effect also results between strip-shaped member 22 and groove 16 as screw 30 is tightened. This effect is further promoted if the length of web-shaped neck 24 is at most exactly equal to that of passage 18. In this manner it is achieved that while screw 30 is tightened, nut-shaped portion 27 of coupling portion 3 is pulled into building block 2, thereby pressing its underside 34 against face 14 of first building block 1 and simultaneously applying a traction to strip-shaped member 22.

If several building blocks 2 are adjoined to the side faces of a building block 1 (in the example up to four), an advantageous mutual clamping effect results: While tightening only one screw of a laterally attached building block 2, a small clamping effect is already applied to building blocks that are adjoined by coupling portions 3 to respective remaining side faces, but tightening is not yet necessary. However, the latter are still displaceable, thereby facilitating the assembly as the blocks do not easily fall off any longer. If building blocks are attached to two or more faces, the clamping effect increases according to the tightening force in grooves 16.

The components of the building block system are preferably produced from plastics material by injection molding. For smaller children, correspondingly larger dimensions will be provided. For example, a basic size of 6 cm may be chosen (face width of first building blocks; diameter of building block 2).

The described exemplary embodiment is preferably intended as a toy building block system.

From the preceding description of an exemplary embodiment, numerous modifications and adaptations are accessible to those skilled in the art without leaving the protective scope of the invention that is defined by the claims. Possible are e.g.:

Applications in sets of building blocks for: modeling; construction of interior decoration objects; playground items; vehicles, particularly for children or for playing purposes.

The shape of the strip-shaped member may be chosen differently, e.g. an expanding wedge shape. It is important for a connection that the strip-shaped portion has an enlargement that forms a positive fit with a corresponding complementarily shaped groove which prevents that the strip-shaped member may be pulled out transversally to the longitudinal axis of the groove.

The thickened portion of the strip-shaped member is divided, e.g. into a series of thickened sections or individual ones, e.g. similarly to balls integrated in the strip-shaped member.

The thickened portion has a cross-section other than circular, e.g. a polygonal and/or deformed circular one (elliptical, oval).

The detachable connecting mechanism is in the form of a snap connection, e.g. a ball and socket connection.

The invention claimed is:

1. A connector for assembly of a first construction element at a first surface thereof to a second construction element in a first direction, which is transverse to the fist surface, the connector having a strip-shaped member which is provided, at an effective distance from a rear edge thereof, with a thickened portion at least on an effective part of its total length, wherein a connecting member is joined to the rear edge of the strip-shaped member and includes a component of a connecting mechanism, wherein the strip-shaped member is insertable into a groove of the first construction element defined in the first surface and the second construction element is attachable to the connecting member by the connecting mechanism, wherein the connecting mechanism comprises elements that are essentially complementary to one another and are insertable into one another in the first direction, wherein the elements that are complementary to one another form a push-in connection, wherein the connecting member of the connecting mechanism includes a nut to enable a screw connection to the second construction element, wherein the second construction element is connectable to the connecting member by a screw receivable from a surface of the second construction element in a direction that is aligned with the first direction, indirectly connectable to the first construction element by the strip-shaped member, and wherein the strip-shaped member has a web-shaped section connected to the connecting member at one side thereof and the thickened portion at an opposing side thereof to space the connecting member and the thickened portion from one another, the web-shaped section following the thickened portion on the side of the rear edge in order to provide a lateral guidance during the insertion of the strip-shaped ember into a groove of a construction element, and wherein the screw is receivable in the nut to realize the screw connection.

2. The connector according to claim 1, wherein the connecting member has an internal thread for receiving a screw.

3. The connector according to claim 1, wherein the thickened portion includes the front edge of the strip-shaped member opposite the rear edge thereof.

4. The connector according to claim 1, wherein the thickened portion extends on at least half the length, preferably on the entire length of the strip-shaped member and is interrupted or uninterrupted.

5. The connector according to claim 1, wherein the width of the web-shaped section is at least a third of an average diameter of the thickened portion, preferably half the average diameter of the thickened portion.

6. A building block set comprising at least one connector according to claim 1, wherein the building block set additionally includes at least one building block that has at least one groove that is shaped essentially complementarily to the strip-shaped member such that a strip-shaped member of a connecting means is insertable into the groove in the longitudinal direction, and/or has at least one complementary component of the connecting mechanism such that a building block and the connector are connectable by the connecting mechanism.

7. The building block set according to claim 6, wherein the groove in the toy building block, starting from the groove opening, has a portion that is configured essentially complementarily to the web-shaped section of the strip-shaped member of the connector, said portion having a depth that is at most equal to the width of the web-shaped section so that a force connection between the strip-shaped member and the building block can be established by a traction effect upon actuating the connecting mechanism.

8. The connector according to claim 1, wherein their parts are made of plastics material.

9. A toy building block set comprising at least one connector according to claim 1.

10. The building block set according to claim 6, wherein it is a toy building block set.

11. The building block set according to claim 5, wherein it includes at least one building block that comprises at least one pluggable connecting mechanism having mutually pluggable elements, the connecting member being such an element essentially.

12. The building block set according to claim 6, wherein its parts are made of plastics material.

13. A toy building block set comprising at least one connector according to claim 8.

14. A construction set, comprising:

a first construction element, a second construction element, and a connector, the connector having a strip-shaped member which is provided, at an effective distance from a rear edge thereof, with a thickened portion at least along a portion of its total length, wherein a connecting member is joined to the rear edge of the strip-shaped member and includes a component of a connecting mechanism, wherein the strip-shaped member is insertable into a groove of the first construction element defined in a first surface of the first construction element and the second construction element is attachable to the connecting member by the connecting mechanism, wherein the connecting mechanism comprises complementary elements that are essentially complementary to one another and are insertable into one another in a first direction, which is transverse to the first surface, wherein the elements that are complementary to one another form a push-in connection, wherein the connecting member of the connecting mechanism includes features to enable a screw connection to the second construction element, wherein the second construction element is connectable to the connecting member by a screw and indirectly connectable to the first construction element by the strip-shaped member, and wherein the strip-shaped member has a web-shaped section connected to the connecting member at one side thereof and the thickened portion at an opposing side thereof to space the connecting member and the thickened portion from one another, the web-shaped section following the thickened portion on the side of the rear edge in order to provide a lateral guidance during the insertion of the strip-shaped member into a groove of a construction element, wherein the complementary elements include an element residing at the second construction element which receives and surrounds another element of the complementary elements in an assembled state, the another element residing at the strip-shaped member.

* * * * *

UNITED STATES PATENT AND TRADEMARK OFFICE

CERTIFICATE OF CORRECTION

PATENT NO. : 8,398,450 B2
APPLICATION NO. : 12/162680
DATED : March 19, 2013
INVENTOR(S) : Wilfried Grichting It is certified that error appears in the above-identified patent and that said Letters Patent is hereby corrected as shown below:

In the Claims

Claim 1, column 4, line 50 should read: “along a portion” not “on an effective part”

Claim 1, column 5, line 8 should read: “member” not “ember”

Claim 6, column 5, line 29 should read: “a connector” not “a connecting means”

Signed and Sealed this
Thirtieth Day of July, 2013

Teresa Stanek Rea
*Acting Director of the United States Patent and Trademark Office*